United States Patent [19]

Strok, Jr.

[11] 4,061,939

[45] Dec. 6, 1977

[54] LOW NOISE SODIUM VAPOR LAMP FOR SONIC PULSE OPERATION

[75] Inventor: Jack M. Strok, Jr., Northfield, Ohio

[73] Assignee: General Electric Company, Schenectady, N.Y.

[21] Appl. No.: 710,486

[22] Filed: Aug. 2, 1976

[51] Int. Cl.[2] ..... H01J 61/068; H01J 61/22; H01J 61/36

[52] U.S. Cl. ..... 313/25; 313/184; 313/217; 313/227; 313/332

[58] Field of Search ..... 313/25, 217, 332, 184, 313/227

[56] References Cited

U.S. PATENT DOCUMENTS

| | | | |
|---|---|---|---|
| 2,918,592 | 12/1959 | Pomfrett et al. | 313/25 |
| 3,832,588 | 8/1974 | McVey et al. | 313/217 |
| 3,882,346 | 5/1973 | McVey | 313/25 X |
| 3,883,763 | 5/1975 | Kearny | 313/25 X |
| 3,899,708 | 8/1975 | Tartakoff et al. | 313/332 X |

*Primary Examiner*—Palmer C. Demeo

*Attorney, Agent, or Firm*—Ernest W. Legree; Lawrence R. Kempton; Frank L. Neuhauser

[57] ABSTRACT

Jacketed high pressure sodium vapor lamps of conventional construction operated on sonic frequency pulses with short duty cycles in order to raise the color temperature produce excessive acoustic noise. The noise level is reduced by using non-magnetostrictive material for the inleads extending from the base into the outer envelope and including the portions embedded in the press of the stem, and for the frame parts that support the arc tube within the outer envelope.

6 Claims, 3 Drawing Figures

LOW NOISE SODIUM VAPOR LAMP FOR SONIC PULSE OPERATION

This invention relates to high pressure sodium vapor lamps specially designed for operation on sonic frequency pulses with short duty cycles in order to raise the color temperature and improve the color rendition, and is concerned with reducing the noise level in such lamps.

BACKGROUND OF THE INVENTION

High pressure sodium vapor lamps are now well-known and widely used for street, roadway and area lighting applications. The basic lamp type is described in U.S. Pat. No. 3,248,590 — Schmidt, 1966, "High Pressure Sodium Vapor Lamp", and generally comprises an outer vitreous envelope or jacket of glass within which is mounted a slender tubular ceramic arc tube. The ceramic envelope is made of a light-transmissive refractory oxide material resistant to sodium at high temperatures, suitably high density polycrystalline alumina or synthetic sapphire. The filling comprises sodium along with a rare gas to facilitate starting, and mercury for improved efficiency. The ends of the alumina tube are sealed by suitable closure members affording connection to the electrodes. The outer envelope is generally provided at one end with a screw base having shell and eyelet terminals to which the electrodes of the arc tube are connected.

Up to the present time high pressure sodium vapor lamps have been conventionally operated on 60 cycle alternating current by means of ballasts which limit the current to the lamp rating. In such operation, the light generated by the discharge is due almost exclusively to the excitation of the sodium atom through the self-reversal and broadening of the sodium D-line at 589 nanometers. The lamp efficacy is high, up to 130 lumens per watt depending upon lamp size, but the color temperature is low, from 1900 °to 2100 ° Kelvin. While object colors in all portions of the spectrum are recognizable, those at the "cool" end such as violets, blues and to some extent greens are muted or grayed down. As a result, the lamp has not been acceptable for indoor applications where critical color discrimination is required.

More recently, the color temperature of high pressure sodium vapor lamps has been raised and their color rendition has been improved by going to pulse operation. The principle is described in copending application Ser. No. 649,900 of Mitchell M. Osteen, filed Jan. 16, 1976, titled "Color Improvement of High Pressure Sodium Vapor Lamps by Pulsed Operation", and assigned like this application. By utilizing pulse repetition rates in the sonic ranges from 500 to 2000 hertz and short duty cycles from 10 to 30%, the color temperature has been increased from the common value of 2050° K to as high as 2700° K with substantially no reduction in lamp efficacy, or even higher than 2700° K at the price of some reduction in efficacy.

SUMMARY OF THE INVENTION

Sonic pulse operation of high pressure sodium vapor lamps of conventional construction produces audible noise. The pulse repetition rate in the range from 500 to 2000 hz determines the fundamental frequency and the ear is sensitive to this range. Also, the noise problem is aggravated by the short duty cycle which means an abrupt rise and fall in current at every pulse inducing higher frequency harmonics which may be even more penetrating. The object of the invention is to provide high pressure sodium vapor lamps which are substantially noisefree on sonic pulse operation, that is, lamps in which the noise level is low enough for comfortable use indoors.

I have determined that a major source of noise in sonic pulse operation of prior art lamps is the stem press or seal of the outer glass envelope or jacket wherein the welds of the inner and outer nickel portions to the intermediate portion of the inleads are embedded in glass. Nickel is magnetostrictive and the dimensional changes in the current carrying nickel wires can couple mechanical energy to the jacket very effectively. My invention replaces the nickel wires by non-magnetostrictive conductors; preferably titanium for the inner conductors and copper for the outer conductors which are connected to the base terminals.

Another source of noise is the frame supporting the arc tube which has conventionally been made of a nickel-iron alloy. My invention substitutes a non-magnetostrictive conductor for nickel-iron of the frame, preferably titanium which can withstand the temperature of operation and also makes a good getter for residual hydrogen or oxygen in the vacuum of the outer envelope. Further noise reduction is achieved by utilizing non-magnetostrictive material for the lamp base, suitably brass for the shell and eyelet, and phosphor bronze for the internal spring cap.

In a lamp design embodying the invention, assembly is made in such manner as to avoid loose parts which could vibrate or rattle during operation, particularly within the arc tube wherein a pressure wave is generated at each pulse.

DETAILED DESCRIPTION

Figure 1:
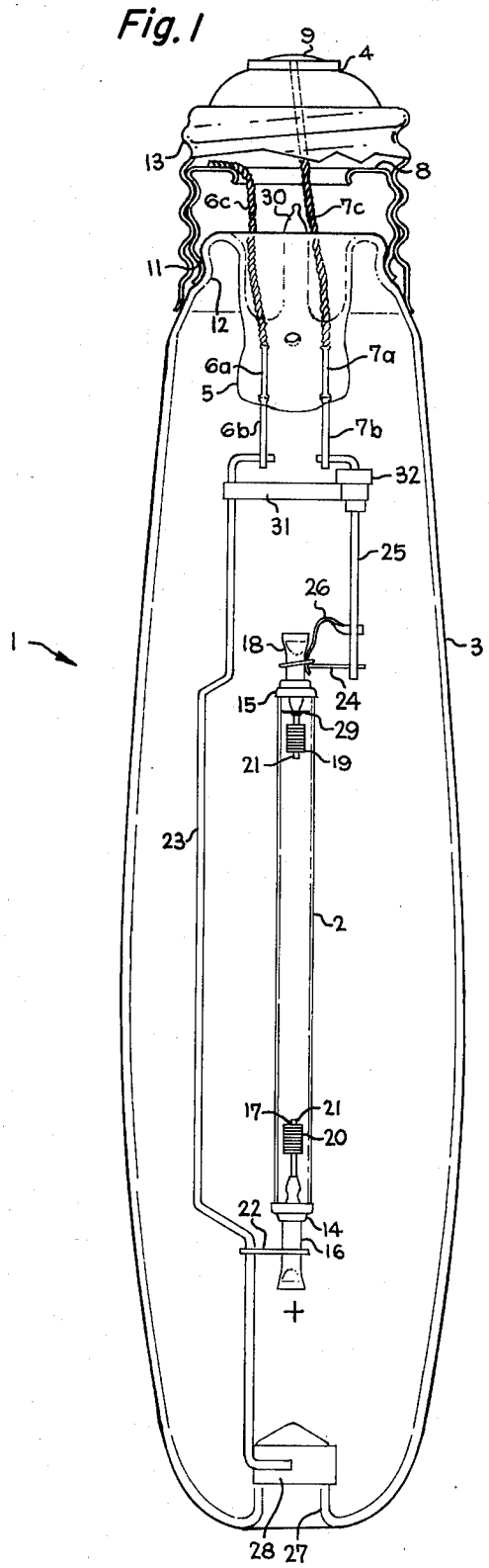
FIG. 1 shows a high pressure sodium vapor lamp intended for sonic pulse operation and having the low noise features embodying the invention.

Referring to FIG. 1, the illustrated lamp 1 embodying the invention is a jacketed high pressure sodium vapor lamp rated for 300 watts input on unidirectional pulse operation. The lamp comprises an inner ceramic arc tube 2 enclosed within an evacuted outer envelope 3 of glass to the neck of which is attached a standard mogul screw base 4. The outer envelope or jacket comprises a re-entrant stem press 5 through which extend a pair of relatively heavy inlead conductors 6, 7 whose outer ends are connected to spring cap 8 and to eyelet 9 of the base. The spring cap engages the neck of the bulb through four springy legs 11 each provided with an embossment which engages a dimple 12 in the glass. The base 4 is fastened by screwing it down on the spring cap and this also makes the connection between inlead 6 and screw shell 13 of the base.

The arc tube 2 centrally located within the outer envelope comprises a length of alumina ceramic tubing, either polycrystalline alumina ceramic which is translucent or single crystal alumina which is clear and transparent. In the drawing, the arc tube is represented as clear to facilitate illustration. End closures consisting of metal caps 14, 15 of niobium which matches the expansion coefficient of alumina ceramic, are sealed to the ends of the tube by means of a glassy sealing composition. A metal tube 16, suitably of niobium or tantalum, extends through cap 14 and serves as an exhaust and fill tubulation during manufacture of the lamp. The illustrated lamp is intended for base-up operation and the exhaust tube is sealed off at its outer end and serves as a reservior in which excess sodium mercury amalgam condenses during operation. Electrode 17 within the lamp is attached to the inward projection of exhaust tube 16, and a dummy exhaust tube 18 extending through metal end cap 15 supports the other electrode 19. Both electrodes may consist of tungsten wire 20 coiled on a tungsten shank 21, suitably in two superposed layers. As example, the arc tube which is 90 mm long by 5.5 mm in bore contains a filling of xenon at a pressure of 20 torr serving as a starting gas, and a charge of 25 mg of amalgam of 25 weight percent sodium and 75 weight percent mercury.

Exhaust tube 16 is connected by connector 22 and long frame member or side rod 23 to inlead 6 which provides circuit continuity to the base shell 13 which is made positive in unidirectional pulsed operation. Dummy exhaust tube 18 extends through a ring support 24 fastened to short L-shaped rod 25; the arrangement provides lateral restraint while allowing axial expansion of the arc tube. A flexible metal strap 26 connects dummy tube 18 to side rod 25 which in turn is welded to inlead 7, thereby providing circuit continuity to base eyelet 9. The distal end of long side rod 23 is braced to inverted nipple 27 in the dome end of the envelope by a clip 28 which engages it.

In a lamp intended for sonic pulse short duty cycle operation, arc stability and overheating of the end closures, particularly that at the anode and when unidirectional pulsing is used, can be a problem. In my copending application Ser. No. 710,487 filed of even date herewith, titled, "High Pressure Sodium Vapor Lamp Stabilized for Pulse Operation" and assigned to the same assignee as the present application, a lamp construction having improved arc stability is described and claimed. Arc stability and long life are achieved and end closure overheating is prevented by using electrodes of cross sectional area from 0.3 to 0.4 times the envelope cross section and by increasing the electrode insertion depth. In addition, the anti back-arcing shield 29 is positioned so that the ratio of arc gap to gas column length is less than 0.80, preferably about 0.70. The lamp illustrated in FIG. 1 has these features and is intended for operation on unidirectional pulses in the sonic range from 500 to 2000 hz at 10 to 30% duty cycle with a 300 watt input. The lamp is operated base-up with the cathode 19 at the upper end. Since the current is unidirectional, only cathode 19 is activated with dibarium calcium tungstate emission material which is contained in the interstices between the two layers of tungsten coiling. The physical structure of anode 17 at the lower end is the same except that no emission material is provided and the anti back-arcing shield is omitted.

OUTER ENVELOPE INLEADS

In the illustrated lamp the neck of the outer bulb or jacket is sealed to the flare of a glass stem 5 which also includes an exhaust tube 30 for evacuating the inter-envelope space. The lead-in conductors 6, 7 comprise intermediate portions *6a, 7a* which are of wire selected to match the coefficient of expansion of the glass, and inner portions *6b, 7b* and outer portions *6c, 7c* which are butt-welded to the intermediate portions. The hermetic seal is made at the intermediate portions *6a, 7a* which are completely embedded in the pressed portion of the stem. In the prior art construction, nickel or nickel-iron alloy was used for the inner portions and frequently for the outer portions as well. By tests conducted in a room-size anechoic chamber, I have determined that major sources of noise are the nickel wires undergoing magnetostriction in the stem press. Since the joints or welds of the nickel portions to the intermediate portions are embedded in glass, their dimensional changes during pulsing can couple mechanical energy to the jacket very effectively. I have found that substituting non-magnetostrictive material for the inleads reduces the noise level significantly, as much as 10 decibels. For example in lamps where the noise level measured 60 db, it dropped to 50 db when the inleads having inner and outer portions of nickel were replaced by all tungsten inleads sealed through a stem of nonex glass which has a coefficient of expansion matching that of tungsten.

In a practical lamp design, tungsten inleads are too expensive and difficult to work. Other non-magnetostrictive metals which could be used are molybdenum, titanium, copper and aluminum. A preferred construction illustrated in the drawing utilizes an intermediate inlead portion *6a* of tungsten, to which is butt-welded on one side an inner portion of *6b* of titanium and on the other side an outer portion *6c* of copper. The copper wire may be stranded as illustrated, or solid, and it is preferably nickel-plated as an anti-oxidation measure. Outer portion *6c* is fastened by welding or soldering to spring cap 8, and outer portion *7c* is similarly fastened to eyelet 9. The spring cap has in the past been made of steel which contributes to noise. It is desirable to replace the steel by non-magnetostrictive material, suitably phosphor bronze which has the needed springiness. Other metallic parts of the base, namely eyelet 9 and screw shell 13 are made of brass.

ARC TUBE FRAME

The interior of the jacket is exhausted and sound is not transmitted through a vacuum. But the frame or mount which supports the arc tube within the jacket is a source of noise and in addition couples noise to the exterior. In the prior art construction long side rod 23 and L-shaped rod 25 were made of nickel-iron alloy which is magnetostrictive. I have found that substituting a non-magnetostrictive material for these parts reduce the noise level another 10 db, that is from 50 to about 40 db. I prefer to use titanium because it is not magnetostrictive and also makes a good getter for residual hydrogen or oxygen. The clip 28 which engages inverted nipple 27 may be made of titanium sheet or else it may be eliminated and the end of rod 23 curved into a ring to encircle the nipple. Strap 31 which is attached to side rod 23 and engages insulator 32 to serve as a stiffening brace does not carry current and does not need to be made of non-magnetostrictive material.

AVOIDANCE OF LOOSE PARTS

Figure 2:
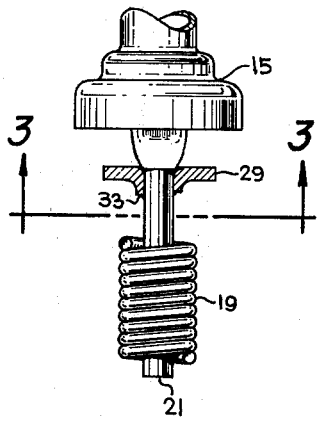
FIGS. 2 and 3 are enlarged side and plan details of the cathode showing the attachment of the anti back-arcing shield.
Figure 3:
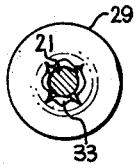

In the arc tube proper, all the conductive parts are of tungsten or niobium, neither of which is magnetostrictive. Nevertheless, it is important to avoid loose parts which could be set into vibration by the longitudinal pressure wave which occurs in the arc tube at each pulse. In particular I have found that the anti back-arcing shield in the form of a small niobium disc 29 mounted on tungsten shank 21 behind cathode 19 can be a source of noise. The prior art practice has been to pierce a clean hole through the disc slightly larger in size than the tungsten shank. The discs are loose on the shank and, in pulse operation of the lamp, they rattle or buzz and sound comes out through the frame and base to the socket. The problem is cured by firmly attaching the shield to the shank. For instance, the disc may be welded to the shank. A preferred simpler solution is to use a nail punch to make an undersized hole through the disc and then to force-press the disc on the shank, causing the formation of sharp points 33 which engage and bite into the shank, as shown in FIG. 2. In lamps wherein these precautions have been observed along with the previously described design features of non-magnetostrictive inleads, frame and base parts, the noise level on pulse operation was lowered 30 db (a factor of 1000) below that of conventional construction. The residual noise level is low enough for comfortable use of the lamps indoor.

What I claim as new and desire to secure by Letters Patent of the United States is:

1. A jacketed high pressure sodium vapor lamp for operation at low noise levels on sonic pulses of short duty cycle comprising:

an elongated light-transmitting ceramic arc tube having conductive electrode-supporting closures sealed to opposite ends and containing an ionizable filling including sodium, said electrodes and closures comprising only non-magnetostrictive material, an evacuated outer vitreous envelope surrounding said arc tube, said envelope having a vitreous stem at one end including a press through which extend a pair of inleads, all portions of said inleads including an intermediate portion sealed through the press, an inner portion passing into the outer envelope, and an outer portion being of non-magnetostrictive metal, a metal wire frame within said envelope for supporting and making electrical connections to said arc tube, said frame comprising a long side rod extending from the inner portion of one inlead to the other end of said envelope, and a short rod extending from the inner portion of the other inlead, both said rods being of non-magnetostrictive metal, and attachments between said arc tube closures and said rods.

2. A lamp as in claim 1 wherein a base consisting entirely of non-magnetostrictive material is attached to the stem end of said outer envelope, and the outer portions of said inleads are connected to contact members in said base.

3. A lamp as in claim 1 wherein said inleads have an intermediate portion of tungsten embedded in the press of the stem and an outer portion of copper and an inner portion of titanium butt-welded to opposite ends of the intermediate portion.

4. A lamp as in claim 1 wherein the rods of said metal wire frame are of titanium.

5. A lamp as in claim 1 wherein the cathode electrode comprises a tungsten wire coil on a tungsten shank and an anti back-arcing shield mounted on the shank behind said coil, said shield being firmly attached in a manner precluding vibratory displacement on said shank.

6. A lamp as in claim 5 wherein said shield is a niobium disc which is centrally pierced and force-pressed on the shank.

* * * * *